US009711915B2

(12) United States Patent
Hiramatsu et al.

(10) Patent No.: US 9,711,915 B2
(45) Date of Patent: Jul. 18, 2017

(54) CONNECTOR HAVING A HOUSING WITH A BACKLASH PREVENTING RIB

(71) Applicant: Sumitomo Wiring Systems, Ltd., Yokkaichi, Mie (JP)

(72) Inventors: Hiroyuki Hiramatsu, Mie (JP); Tomohiko Kobayashi, Mie (JP); Yoshihiro Mizutani, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/309,246

(22) PCT Filed: Apr. 30, 2015

(86) PCT No.: PCT/JP2015/062925
§ 371 (c)(1),
(2) Date: Nov. 7, 2016

(87) PCT Pub. No.: WO2015/178185
PCT Pub. Date: Nov. 26, 2015

(65) Prior Publication Data

US 2017/0070012 A1 Mar. 9, 2017

(30) Foreign Application Priority Data

May 20, 2014 (JP) ..... 2014-104398

(51) Int. Cl.
*H01R 13/502* (2006.01)
*H01R 24/20* (2011.01)
(Continued)

(52) U.S. Cl.
CPC ..... *H01R 24/20* (2013.01); *H01R 13/46* (2013.01); *H01R 13/502* (2013.01); *H01R 13/52* (2013.01);
(Continued)

(58) Field of Classification Search
CPC .... H01R 13/46; H01R 13/502; H01R 13/504; H01R 13/52; H01R 13/5202; H01R 24/20; H01R 24/28
(Continued)

(56) References Cited

U.S. PATENT DOCUMENTS 7,066,747 B2 * 6/2006 Nagano ..... H01R 13/641 439/157
7,794,288 B2 * 9/2010 Shindo ..... H01R 13/533 439/347
(Continued)

FOREIGN PATENT DOCUMENTS

JP 2006-24456 1/2006
JP 2007-59153 3/2007
(Continued)

OTHER PUBLICATIONS

English translation of PCT/JP 2015 062925, Apr. 30, 2015, 4 pages.*
(Continued)

*Primary Examiner* — Chandrika Prasad
(74) *Attorney, Agent, or Firm* — Gerald E. Hespos; Michael J. Porco; Matthew T. Hespos

(57) ABSTRACT

A connector has a male housing (10) with a forwardly open receptacle (11) and a female housing (40) with a terminal accommodating portion (42) that fits into the receptacle (11). A front wall (70) is mounted on a front of the terminal accommodating portion (42) and provides terminal insertion holes (55). Fitting projections (20) are formed on an inner peripheral surface of the receptacle (11), and fitting grooves (60) are formed on an outer peripheral surface of the terminal accommodating portion (42) for receiving the fitting projections (20). Backlash preventing ribs (61) are formed on inner surfaces of the fitting grooves (60) and are squeezed between inner surfaces of the fitting grooves (60)
(Continued)

and outer surfaces of the fitting projections (20). The front wall (70) has escaping grooves (80) configured to allow the fitting projections (20) to be passed therethrough with a clearance and inserted into the fitting grooves (60).

3 Claims, 16 Drawing Sheets

(51) Int. Cl.
*H01R 13/46* (2006.01)
*H01R 13/52* (2006.01)
*H01R 24/28* (2011.01)
*H01R 103/00* (2006.01)

(52) U.S. Cl.
CPC ..... *H01R 13/5202* (2013.01); *H01R 24/28* (2013.01); *H01R 2103/00* (2013.01)

(58) Field of Classification Search
USPC ..... 439/686, 690, 691
See application file for complete search history.

(56) References Cited

U.S. PATENT DOCUMENTS

| | | | | |
|---|---|---|---|---|
| 2006/0009058 | A1 | 1/2006 | Nagano et al. | |
| 2008/0299816 | A1 | 12/2008 | Itou et al. | |
| 2009/0325416 | A1* | 12/2009 | Shindo | H01R 13/533 439/346 |
| 2010/0151742 | A1* | 6/2010 | Shindo | H01R 13/533 439/650 |
| 2014/0106603 | A1 | 4/2014 | Hiramatsu | |

FOREIGN PATENT DOCUMENTS

| | | |
|---|---|---|
| JP | 2008-166046 | 7/2008 |
| JP | 2011-187377 | 9/2011 |

OTHER PUBLICATIONS

International Search Report of Jun. 23, 2015.
European Search Report Dated Apr. 4, 2017.

* cited by examiner

CONNECTOR HAVING A HOUSING WITH A BACKLASH PREVENTING RIB

BACKGROUND

1. Field of the Invention

This specification relates to a connector that prevents backlash between male and female housings.

2. Description of the Related Art

Japanese Unexamined Patent Publication No. 2008-166046 discloses a waterproof connector configured to prevent backlash between male and female housings. The male housing accommodates male terminals and is shaped to include a receptacle in which tip parts of the male terminals are located. The female housing is shaped such that a cover is formed around a terminal accommodating portion for accommodating female terminals. Further, a packing is fit on the outer periphery of a base end side of the terminal accommodating portion of the female housing and a front wall is fit and retained on the front surface of the terminal accommodating portion.

The male and female housings are configured such that the terminal accommodating portion of the female housing is fit into the receptacle of the mating male housing while the cover is fit outside the receptacle. The male and female terminals are connected when the male and female housings are connected properly, and sealing is provided between the two housings by the packing being resiliently compressed between the terminal accommodating portion and the receptacle.

A backlash preventing structure includes a backlash preventing rib and a fitting groove. The backlash preventing rib has a chevron-shaped cross-section and is formed on the outer peripheral surface of the front wall member to extend in a front-back direction. The fitting groove has a trapezoidal cross-section narrower than the backlash preventing rib and is formed on the inner peripheral surface of the receptacle of the male housing. Backlash is prevented by opposite skirt portions of the backlash preventing rib and opening edges of the fitting groove squeezing each other.

In the above conventional technique, backlash between the male and female housings is prevented by the backlash preventing structure set between the male housing and the front wall fit on the female housing, i.e. prevented via another member. Thus, considering the presence of a clearance between the female housing and the front wall, backlash between the male and female housings may be insufficiently prevented and, eventually, it may not be possible to suppress fine sliding abrasion between the male and female terminal fittings sufficiently.

A connector disclosed by this specification is completed based on the above situation and reliably prevents backlash between male and female housings.

SUMMARY

This specification is directed to a connector with a male housing, a female housing and a front wall. The male housing includes a forwardly open receptacle and is configured such that a male terminal is accommodated therein while projecting into the receptacle. The female housing includes a terminal accommodating portion having a cavity for accommodating a female terminal and is fittable into the receptacle. The front wall is mounted on a front surface of the terminal accommodating portion and is configured to provide a terminal insertion hole through which the male terminal is to be inserted and that communicates with the cavity. A fitting projection extends in a front-back direction on an inner peripheral surface of the receptacle in the male housing. A fitting groove is formed on an outer peripheral surface of the terminal accommodating portion in the female housing, and the fitting projection is insertable therein from the front. A backlash preventing rib is formed on the inner surface of the fitting groove and extends in the front-back direction to be squeezed between an inner surface of the fitting groove and an outer surface of the fitting projection. The front wall is formed with an escaping groove configured to allow the fitting projection to be passed therethrough with a clearance and inserted into the fitting groove.

When the male and female housings are connected, the fitting projection formed on the inner peripheral surface of the receptacle of the male housing is passed through the escaping groove formed in the front wall and is inserted from the front into the fitting groove formed on the outer peripheral surface of the terminal accommodating portion of the female housing. As the fitting projection is inserted, the backlash preventing rib formed on the inner surface of the fitting groove is squeezed, thereby preventing backlash.

Backlash between the male housing and the terminal accommodating portion of the female housing is prevented directly, and fine sliding abrasion between the male and female terminal fittings accommodated in them can be suppressed more reliably.

The terminal accommodating portion of the female housing may include a cover to be fit to an outer periphery of the receptacle of the male housing. A seal ring may be mounted on the outer periphery of the base end side of the terminal accommodating portion and may be compressed resiliently between an outer periphery of a base end side of the terminal accommodating portion and an inner periphery of the receptacle. The front wall may double as a ring presser configured to prevent the fall of the seal ring.

A force may act to open the receptacle when the fitting projection squeezes the backlash preventing rib to prevent backlash. However, such an opening force is suppressed by the cover. Thus, the backlash preventing rib is squeezed more reliably and, eventually, backlash is prevented more reliably.

At least either one of the backlash preventing rib and the squeezing surface of the fitting projection for squeezing the backlash preventing rib may be tapered to become gradually taller from a tip side toward a rear end side in a connecting direction. As the connection of the male and female housings proceeds, the backlash preventing rib gradually becomes more squeezed. As compared to the case where the backlash preventing rib is squeezed by a predetermined amount from the beginning, a connecting operation of the male and female housings is performed smoothly so that a good connection feeling can be obtained.

According to the connector disclosed by this specification, it is possible to reliably prevent backlash between male and female housings.

DETAILED DESCRIPTION

An embodiment is described with reference to FIGS. 1 to 16.

Figure 1:
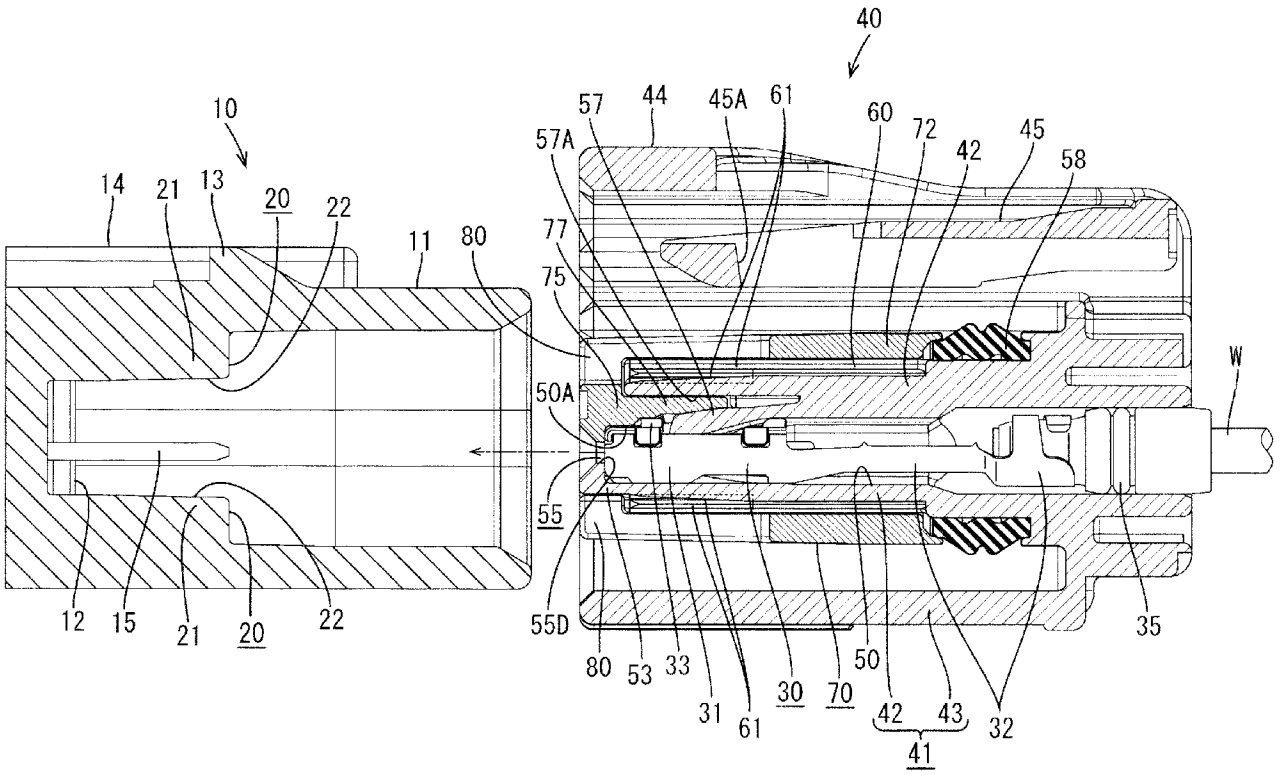
FIG. 1 is a longitudinal section showing a connecting operation of male and female housings according to an embodiment.

In this embodiment, a waterproof connector of a type to be directly connected to a device is illustrated. As shown in FIG. 1, a male housing 10 and a female housing 40 to be connected to each other are provided. In the following description, a connection end side of each housing 10, 40 is referred to as a front side.

Figure 2:
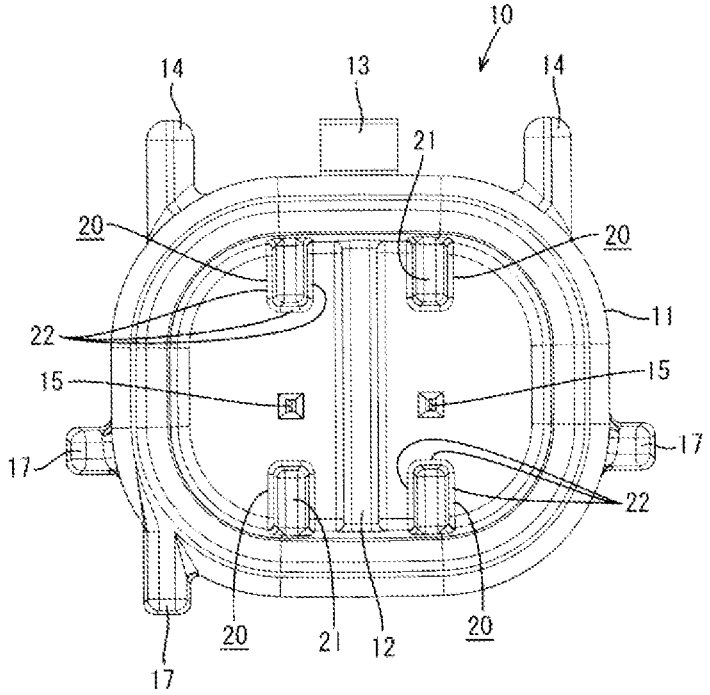
FIG. 2 is a front view of the male housing.
Figure 3:
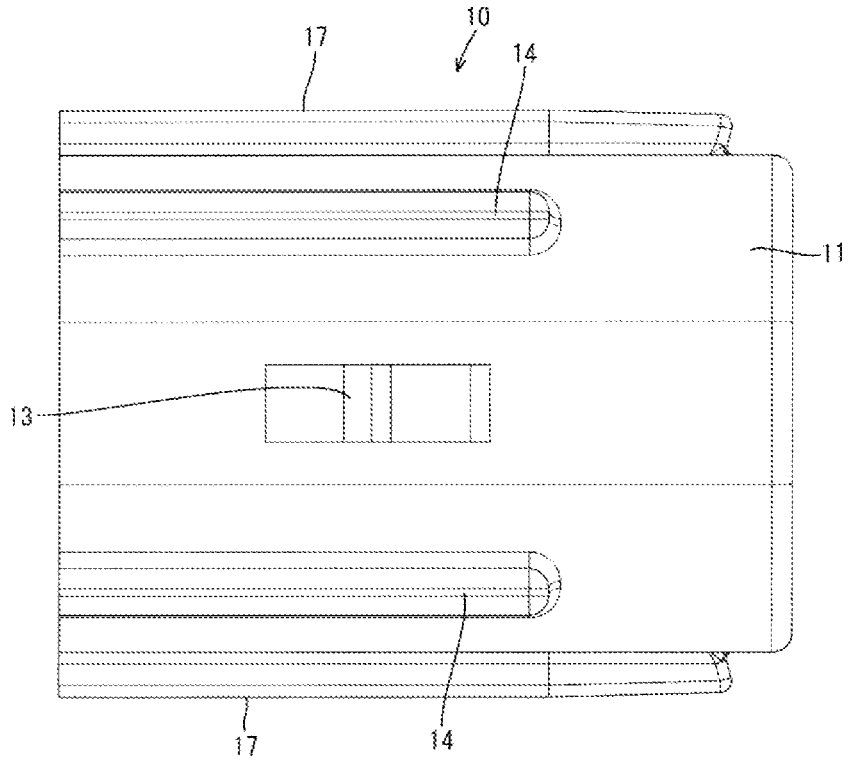
FIG. 3 is a plan view of the male housing.

The male housing 10 is formed integrally on a wall surface of a device case made of synthetic resin and includes a receptacle 11 open forward, as shown in FIGS. 1 to 3. The receptacle 11 is in the form of a tube having a laterally long rectangular cross-sectional shape with rounded corners and having a front surface opening.

Two tab-shaped male terminals 15 project from the back surface of the receptacle 11 while being laterally spaced apart and arranged side by side. The tip of each male terminal 15 projects to a position a little closer to the back surface than a center of the receptacle 11 in a depth direction. A vertically extending short partition 12 is formed between the male terminals 15.

Left and right protection walls 14 stand on the upper surface of the receptacle 11 and extending in the front-back direction. A lock protrusion 13 is formed between the protection walls 14 and is to be engaged with a lock arm 45 of the female housing 40 to be described later. Further, as shown in FIG. 2, three guide walls 17 extend in the front-back direction to guide connection (prevent forcible connection) to the mating female housing 40. The guide walls 17 are formed over substantially the entire length at positions near lower end parts of both left and right side surfaces of the receptacle 11 and at a left end position of the lower surface of the receptacle 11 in a front view.

As shown in FIG. 1, the female housing 40 is composed of a housing main body 41 and a front wall 70 both made of synthetic resin, and two female terminals 30 connected to ends of wires W are accommodated in the female housing 40. The female terminal 30 is formed by press-working a metal plate excellent in conductivity and includes, as shown in FIG. 1, a connecting portion 31 in the form of a rectangular tube into which the mating male terminal 15 is to be inserted and a barrel portion 32 provided on the rear end and crimped to the end of the wire W together with a waterproof rubber plug 35.

Figure 4:
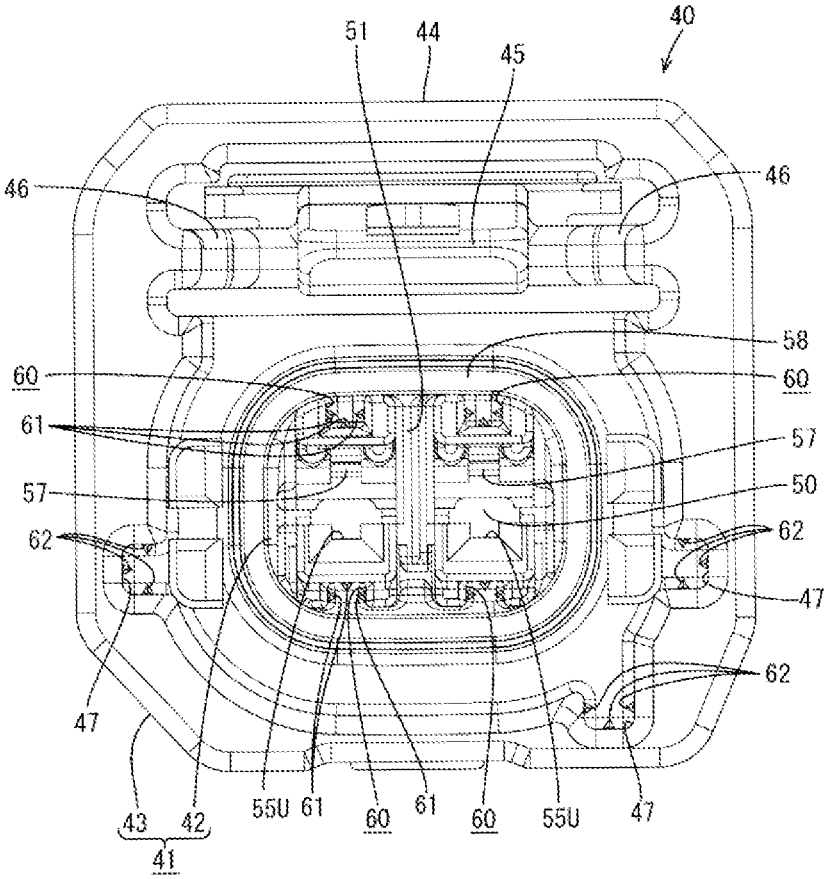
FIG. 4 is a front view of the female housing.

As shown in FIGS. 1 and 4, the housing main body 41 of the female housing 40 is shaped such that a cover 43 is formed around a terminal accommodating portion 42. The cover 43 is in the form of a tube having a front surface opening and is to be fit substantially tightly to an outer peripheral side of the receptacle 11 of the male housing 10 described above. An arch 44 that is short in height is formed on the upper surface of the cover portion 43 and opens backward. A part of the male housing 10 where the lock protrusion 13 is formed and that includes the protection walls 14 is fittable from the inside of the arch 44 to an area behind the arch 44.

Figure 5:
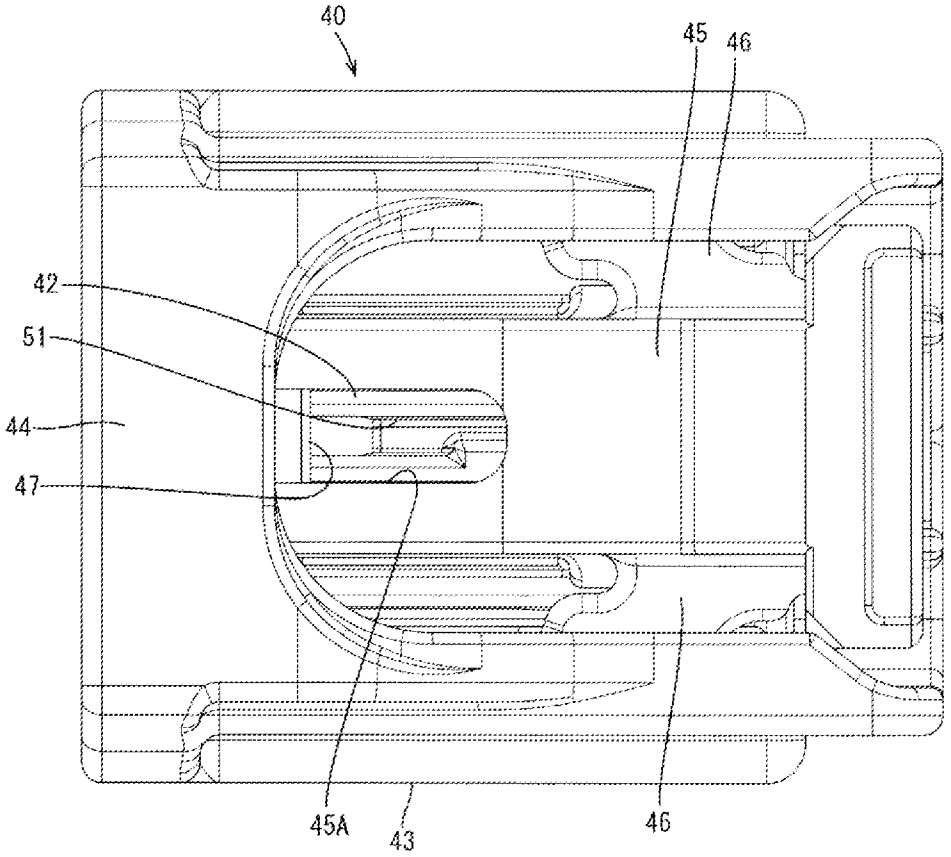
FIG. 5 is a plan view of the female housing.

The lock arm 45 is arranged from the inside of the arch 44 to the area behind the arch 44. As shown in FIGS. 4 and 5, the lock arm 45 is cantilevered forward from a support 46 on a rear end side coupled to inner side surfaces of a rear end of the cover 43, and a tip side thereof is resilient displaceable in a vertical direction with the support 46 as a center. A lock hole 45A is open on a tip part of the lock arm 45 and can receive the lock protrusion 13 of the female housing 40.

Further, as shown in FIG. 4, the inner peripheral surface of the cover 43 is cut from the front edge at positions near lower end parts of left and right side surfaces and at a right end position of the lower surface in a front view, thereby forming guide grooves 47 into which the guide walls 17 of the male housing 1 are to be fit.

Figure 9:
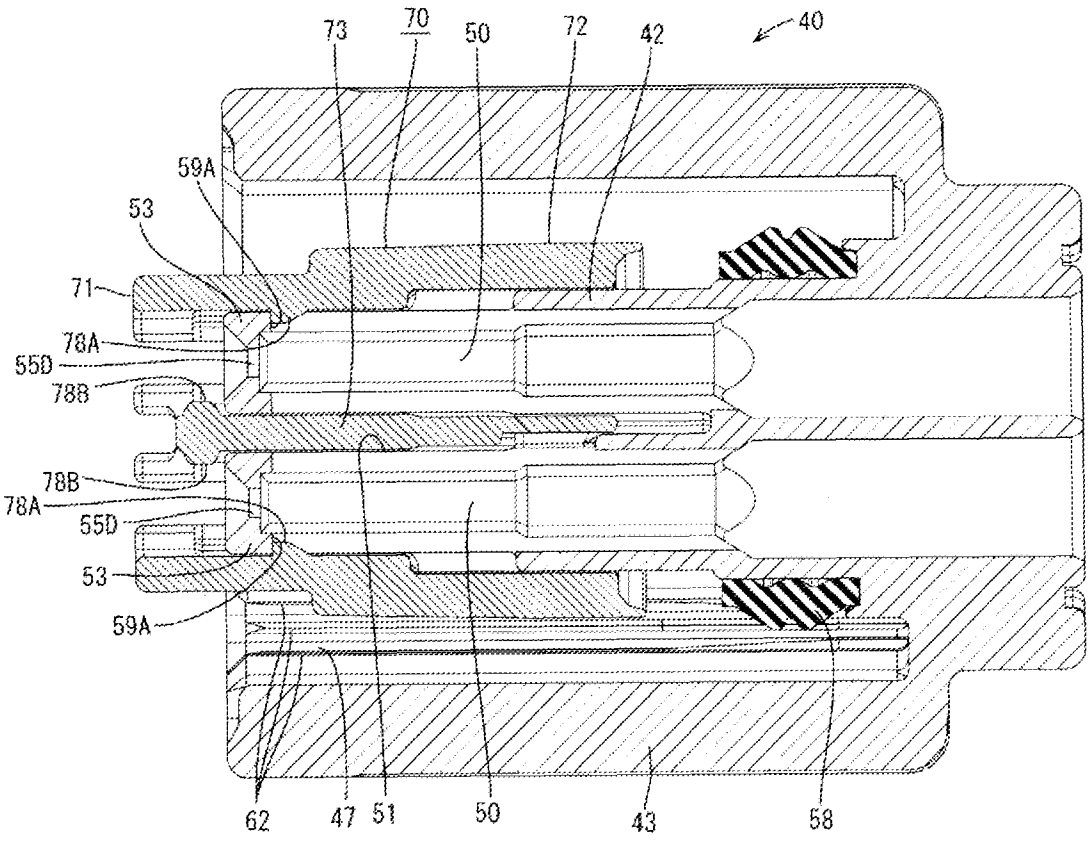
FIG. 9 is a plan view in section showing a state where the front wall member is mounted at a temporary holding position.

The terminal accommodating portion 42 of the housing main body 41 is formed into a tower that is long in the front-back direction and is to be fit into the receptacle 11 of the male housing 10 with a predetermined clearance therebetween, and the tip surface thereof is located at a position retracted by a predetermined dimension from the opening edge of the cover 43. The terminal accommodating portion 42 has two cavities 50 that extend in the front-back direction. The cavities are formed side by side at the same interval as the male terminals 15 in the mating male housing 10, and the female terminals 30 are to be accommodated in the cavities 50. As shown in FIG. 9, a partition groove 51 is formed by cutting to extend from the front surface between the cavities 50.

As described above, since the tip surface of the terminal accommodating portion 42 is retracted to be behind the opening edge of the cover 43, an upper half of a front end part of the cavity 50 is open due to a missing front wall and peripheral wall as shown in FIG. 1. On the other hand, a lower half of the front end part of the cavity 50 is closed since an extending wall 53 constituting the front wall and the peripheral wall is formed to extend integrally. A lower insertion hole 55D constituting a lower half of a terminal insertion hole 55 through which the male terminal 15 is to be inserted is formed on the upper edge of the front wall of this extending wall 53.

A locking lance 57 is provided at the ceiling surface of each cavity 50 for resiliently locking a locking portion 33 formed on the upper surface of the connecting portion 31 of the female terminal 30. The locking lance 57 is cantilevered forward, and a tip side thereof is resiliently deflectable toward a deflection permitting space 57A.

The front wall 70 is formed separately from the housing main body 41 and is fit on the front surface of the terminal accommodating portion 42. As shown in FIGS. 1 and 6 to 8, the front wall 70 is shaped such that a tubular portion 72 covering most of the outer peripheral surface of the front end side of the terminal accommodating portion 42 projects from a peripheral edge part of the rear surface of a thick front wall portion 71 held in contact with the front surface of the terminal accommodating portion 42. The tubular portion 72 has a cross-sectional shape to fit tightly into the receptacle 11 of the mating male housing 10. As shown in FIG. 9, a partition wall 73 projects in a widthwise central part of the rear surface of the front wall portion 71 and is insertable into the partition groove 51 formed in the terminal accommodating portion 42.

Figure 6:
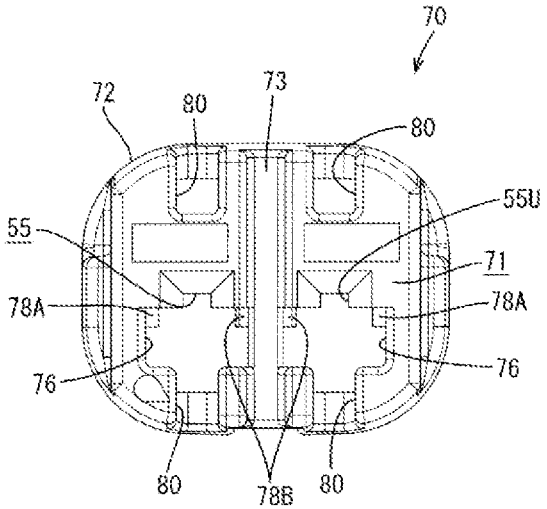
FIG. 6 is a front view of a front wall member.

As shown in FIG. 1, left and right auxiliary walls 75 are formed on the rear surface of the front wall portion 71. Each of auxiliary walls 75 is composed of a front wall and a peripheral wall to define auxiliary cavities 50 for accommodating the upper halves of the front end parts of the connecting portions 31 of the female terminals 30. As shown in FIG. 6, an upper insertion hole 55U is formed on the lower edge of the front wall of the auxiliary wall 75 to define an upper half of the terminal insertion hole 55 into which the male terminal 15 is be inserted.

Further, two left and right fit-in holes 76 are open on the front wall portion 71 and receive the extending walls 53 that extend from the terminal accommodating portion 42.

Figure 13:
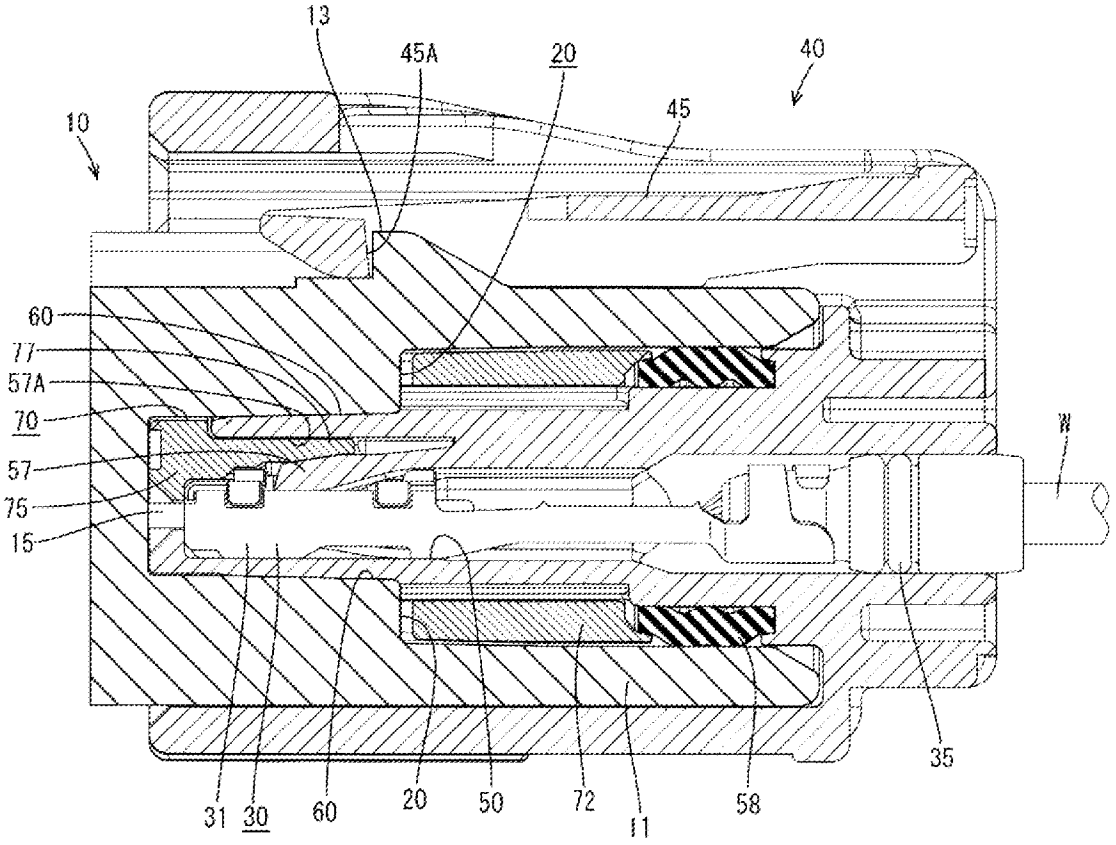
FIG. 13 is a longitudinal section when the connection is completed.
Figure 14:
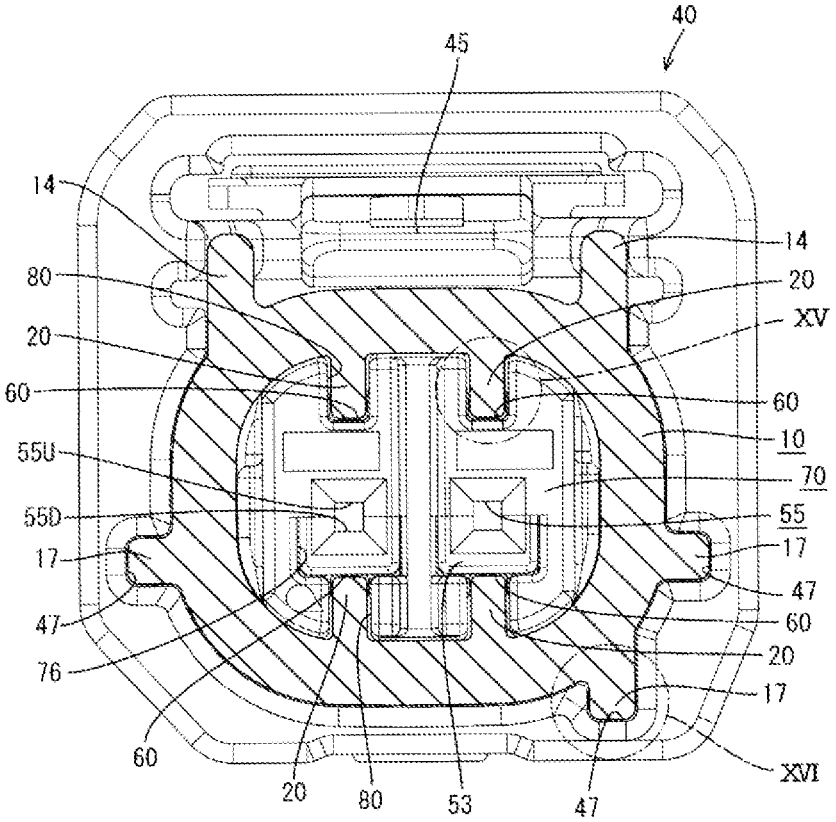
FIG. 14 is a schematic lateral section showing a backlash prevented state when the connection is completed.

As shown in FIG. 13, a deflection restricting piece 77 projects from the rear surface of the auxiliary wall 75 for restricting the deflection and displacement of the locking lance 57 by entering the deflection permitting space 57A for the locking lance 57.

A seal ring 58 is fit on the outer peripheral surface of the base end side of the terminal accommodating portion 42 and is compressed resiliently between the outer peripheral surface of a base end side of the terminal accommodating portion 42 and the inner peripheral surface of the receptacle 11 of the mating male housing 10. The front wall 70 also functions to retain the seal ring 58.

Figure 10:
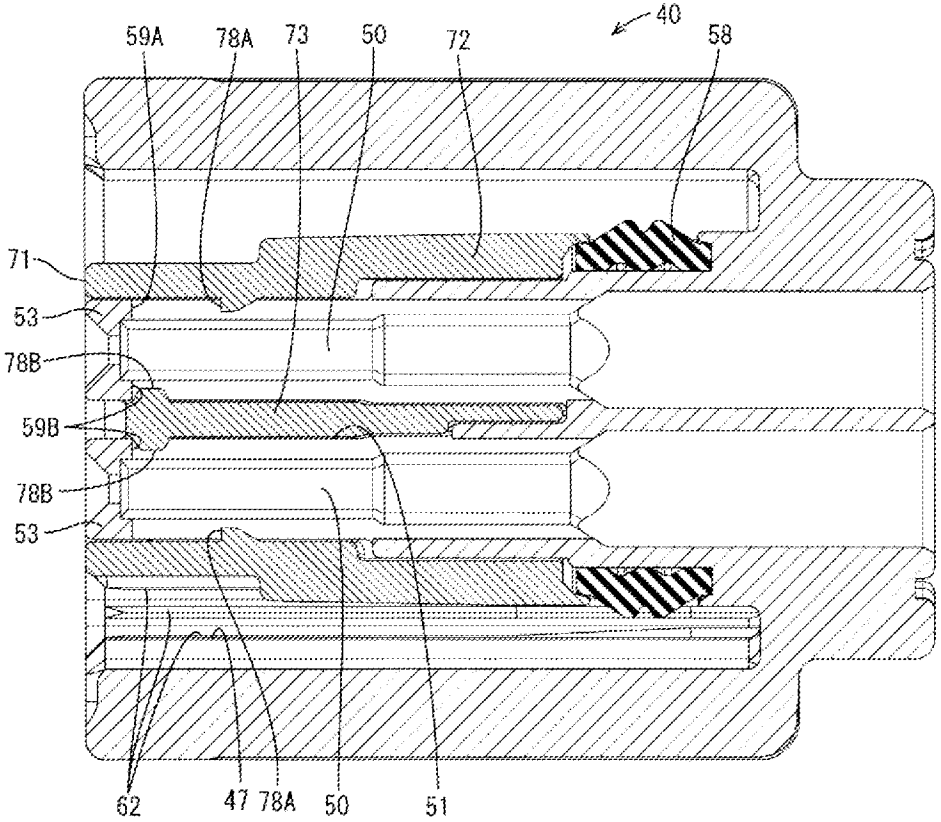
FIG. 10 is a plan view in section showing a state where the front wall member is mounted at a full holding position.

As shown in FIG. 9, the front wall 70 is retained and mounted at a temporary holding position by temporary holding protrusions 78A formed on left and right inner side surfaces of the tubular portion 72 being locked to the front surfaces of temporary holding grooves 59A formed on outer side walls of the respective cavities 50. The front wall 70 is pushed from the temporary holding position and full holding protrusions 78B formed on both left and right surfaces of a base end part of the partition wall 73 are locked to the front surfaces of full holding grooves 59B formed on inner side walls of the respective cavities 50, as shown in FIG. 10. Thus, the front wall member 70 is mounted and locked at a full holding position.

Figure 11:
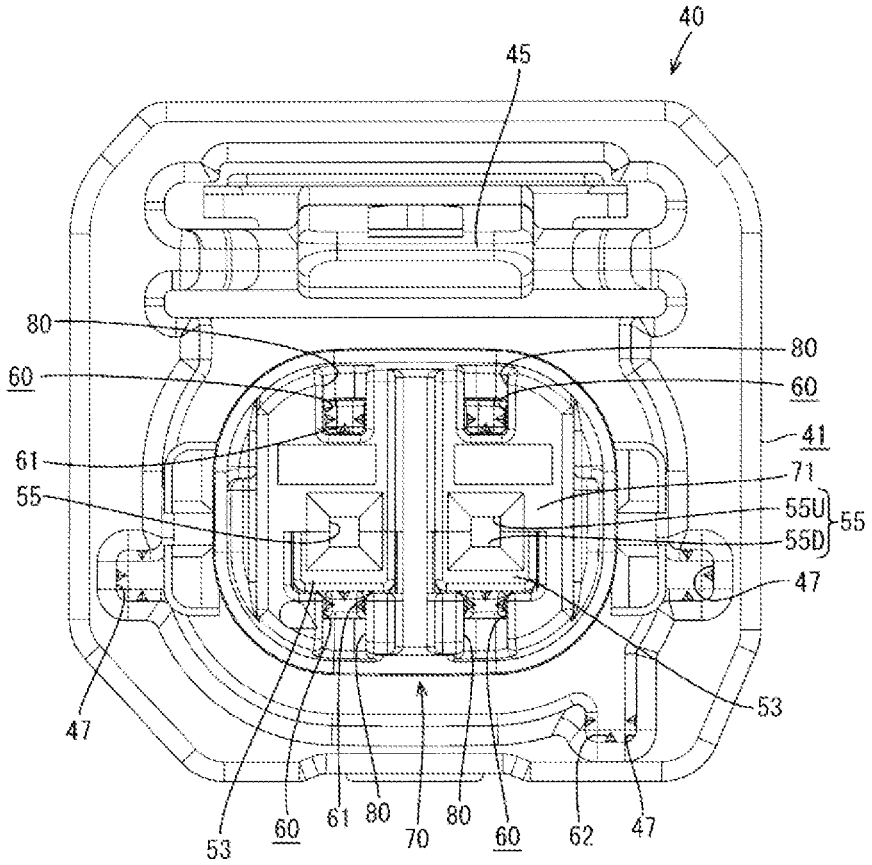
FIG. 11 is a front view showing the state where the front wall member is mounted at the full holding position.

The front wall 70 is mounted and locked at the full holding position, as described above. Thus, the front surface of the front wall portion 71 of the front wall 70 is aligned substantially with the position of the opening edge of the cover 43, and the auxiliary walls 75 formed on the rear surface of the front wall portion 71 are arranged to cover spaces above the extending walls 53, as shown in FIG. 1, thereby forming the cavities 50 having front ends closed. Simultaneously, as shown in FIG. 11, the upper and lower insertion holes 55U, 55D are united to form the terminal insertion holes 55.

The female terminal 30 is inserted into the cavity 50 from behind while resiliently displacing the locking lance 57 with the front wall 70 mounted at the temporary holding position. The insertion is stopped when the front surface of the connecting portion contacts the front wall of the extending wall 53, and the locking lance 57 is restored and displaced to be locked to the locking portion 33 so that the female terminal 30 is primarily locked. The front wall 70 then is pushed to the full holding position and locked to form the properly shaped cavities 50*ef*. The female terminals 30 then are accommodated properly in the cavities 50, and the deflection restricting pieces 77 enter the deflection permitting spaces 57A above the locking lances 57 to restrict the resilient deflection of the locking lances 57, and hence to achieve an indirect double locking of the female terminal 30.

Further, the rear edge of the tubular portion 72 reaches the front surface of the seal ring 58 fit on the outer peripheral surface of the base end side of the terminal accommodating portion 42 to prevent the seal ring 58 from coming out forward.

Next, a backlash preventing structure is described.

As shown in FIG. 2, two fitting projections 20 extending in the front-back direction are formed on each of the upper and lower surfaces of the inner peripheral surface of the receptacle 11 of the male housing 10.

The fitting projections 20 are right below or above the male terminals 15 and extend from the back surface of the receptacle 11 to the positions of the tips of the male terminals 15 while having a predetermined height, as shown in FIG. 1.

A substantially half area on an extending end side of the fitting projection 20 defines a squeezing portion 21, and the top surface and both left and right side surfaces of this squeezing portion 21 define squeezing surfaces 22. Each squeezing surface 22 is tapered.

On the other hand, as shown in FIG. 4, two fitting grooves 60 are formed on each of the upper and lower surfaces of the outer peripheral surface of the terminal accommodating portion 42 in the housing main body 41 of the female housing 40 and the upper or lower fitting projections 20 formed in the receptacle 11 of the male housing 10 are inserted respectively into the fitting grooves 60 from the front. As shown in FIG. 1, each fitting groove 60 is open on the front surface and extends up to the vicinity of the fitted position of the seal ring 58. The fitting projection 20 of the male housing 10 is inserted in a substantially front half area of the fitting groove 60.

As shown in FIGS. 1 and 4, first backlash preventing ribs 61 extending in the front-back direction are formed on the bottom surface (groove bottom surface) and both left and right side surfaces of the front half area of the fitting groove 60 to be squeezed between the squeezing surfaces 22 of the fitting projection 20 and the bottom surface and left and right side surfaces. The first backlash preventing rib 61 has a triangular cross-sectional shape and is tapered to become gradually taller from a tip toward a base end (see FIG. 15).

Figure 7:
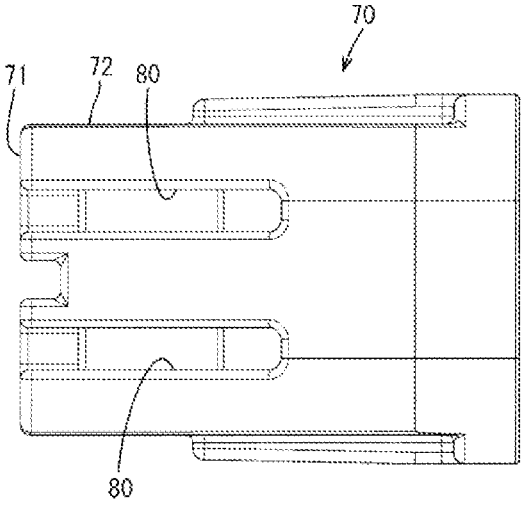
FIG. 7 is a plan view of the front wall member.
Figure 8:
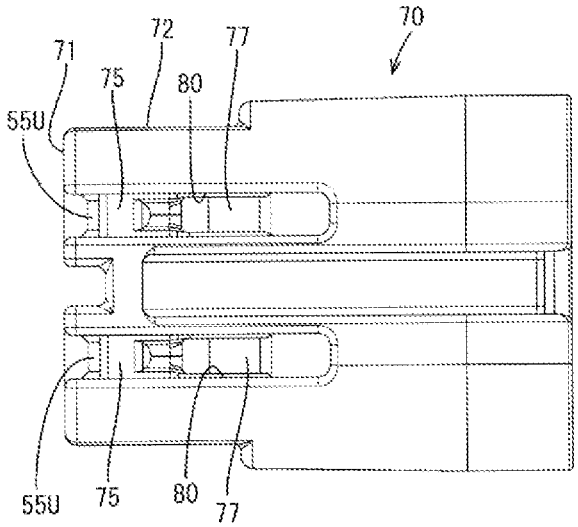
FIG. 8 is a bottom view of the front wall member.

As shown in FIGS. 6 to 8, two escaping grooves 80 are formed on each of the upper and lower surfaces of the front wall member 70 to communicate with the upper or lower fitting grooves 60 provided in the terminal accommodating portion 42. The upper or lower fitting projections 20 formed in the receptacle 11 of the male housing 10 can be passed through the escaping grooves 80 with a clearance.

Figure 16:
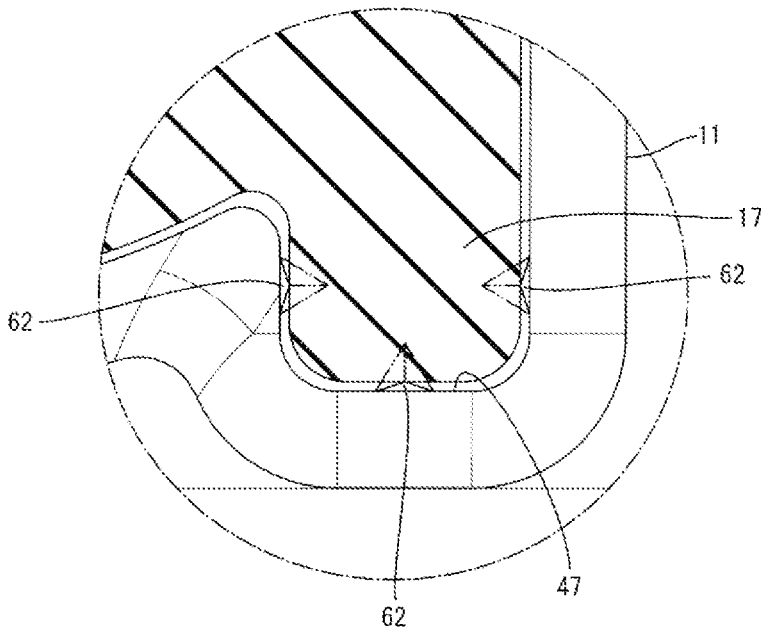
FIG. 16 is an enlarged view of a part XVI of FIG. 14.

Further, second backlash preventing ribs 62 extending in the front-back direction and to be squeezed between the guide walls 17 formed on the outer peripheral surface of the receptacle 11 of the male housing 10 and the bottom surfaces (groove bottom surfaces) and both left and right side surfaces of the three guide grooves 47 provided on the inner peripheral surface of the cover 43 of the female housing 40 are formed on these bottom surfaces and left and right side surfaces as shown in FIG. 4. The second backlash preventing rib 62 has a triangular cross-sectional shape similar to the first backlash preventing rib 61. Note that the second backlash preventing rib 62 may also be tapered to become gradually taller from a tip toward a base end as shown in FIG. 16. Further, the guide walls 17 may also be tapered.

Next, functions of this embodiment are described.

The female housing 40 is assembled in the manner described above. The description of this assembling is briefly repeated. The female terminal 30 fixed to the end of the wire W together with the rubber plug 35 is inserted from behind into each cavity 50 of the female housing 40 with the seal ring 58 mounted and the front wall 70 mounted at the temporary holding position. When being pushed to a proper position, the female terminal 30 is locked primarily by the locking lance 57 and the rubber plug 35 is mounted at the entrance of the cavity 50. Subsequently, the front wall 70 is pushed to and locked at the full holding position. Mounting the front wall 70 at the full holding position forms the cavities 50 with a proper shape so that the rectangular terminal insertion hole 55 is open on the front surface. The female terminals 30 are accommodated properly in these cavities 50 and the deflection restricting pieces 77 enter the deflection permitting spaces 57A to restrict the resilient deflection of the locking lances 57, thereby indirectly locking the female terminal 30 doubly.

Simultaneously, the escaping grooves 80 provided on the front wall 70 are arranged to be connected before the fitting grooves 60 formed in the terminal accommodating portion 42.

The assembled female housing 40 is connected to the mating male housing 10, as indicated by an arrow in FIG. 1. The female housing 40 is pushed while being guided straight by aligning the guide grooves 47 on the upper and lower surfaces with the corresponding guide walls 17 of the male housing 10. The terminal accommodating portion 42 of the female housing 40 having the front wall 70 mounted is inserted into the receptacle 11, and the cover 43 is fit to the outside of the receptacle 11. During this time, the guide walls 17 on the outer surfaces of the receptacle 11 are pushed while squeezing the second backlash preventing ribs 62 on the inner surfaces of the mating guide walls 47.

Figure 12:
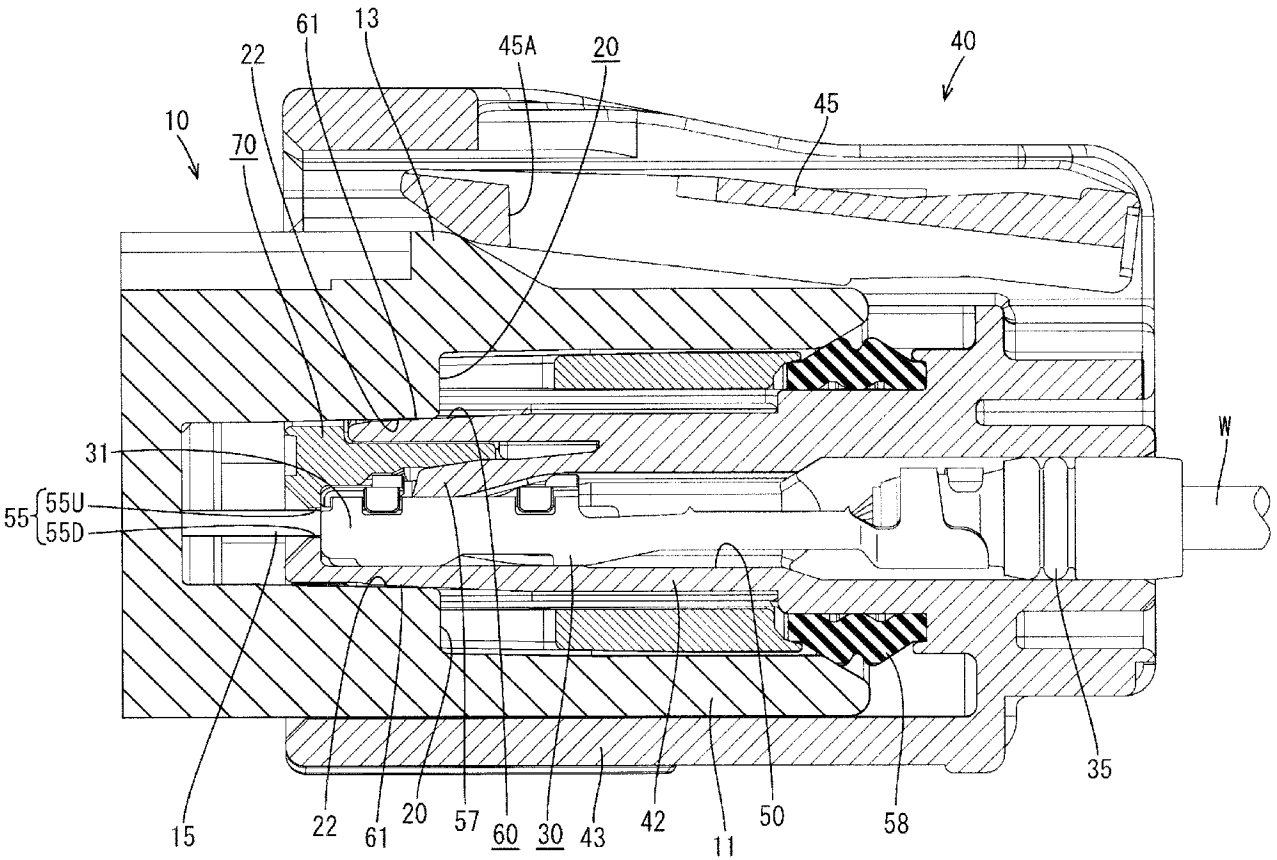
FIG. 12 is a longitudinal section showing a state while the male and female housings are being connected.

As the connection proceeds, the upper and lower fitting projections 20 formed on the inner peripheral surface of the receptacle 11 of the male housing 10 are inserted into the fitting grooves 60 formed on the outer peripheral surface of the terminal accommodating portion 42 from the front, as shown in FIG. 12, after passing through the escaping grooves 80 formed on the upper and lower surfaces of the front wall 70, and the first backlash preventing ribs 62 formed on the inner surfaces of the fitting grooves 60 are squeezed gradually as the fitting projections 20 are inserted.

As the connection proceeds, the tip of the lock arm 45 moves onto the lock protrusion 13 and the lock arm 45 is pushed while being deflected and displaced. When the front surface of the front wall 70 of the female housing 40 is pushed to a proper position to contact the back surface of the receptacle 11 of the male housing 10, the male terminals 15 are inserted by a proper amount into the connecting portions 31 of the corresponding female terminals 30 through the terminal insertion holes 55. Thus, the male and female terminal fittings 15, 30 are connected electrically to each other. Additionally, the lock hole 45A of the lock arm 45 passes the lock protrusion 13, as shown in FIG. 13, and the lock protrusion 13 is fit into the lock hole 45A while the lock arm 45 is restored and displaced so that the male and female housings 10, 40 are locked in a connected state. Further, the seal ring 58 is sandwiched resiliently between the outer periphery of the base end part of the terminal accommodating portion 42 and the inner periphery of the opening side of the receptacle 11 to provide waterproofing between the male and female housings 10, 40.

Figure 15:
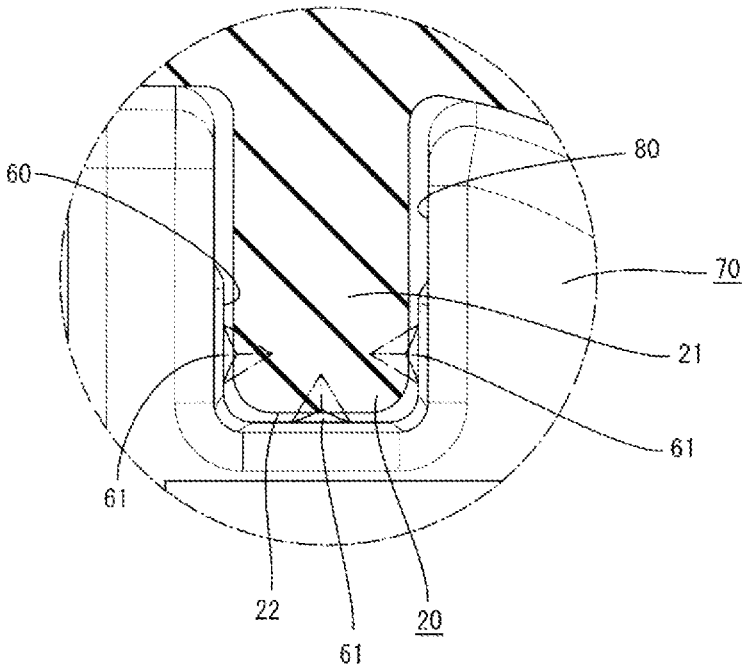
FIG. 15 is an enlarged view of a part XV of FIG. 14.

In such a state, the first backlash preventing ribs 61 provided on the inner surfaces of the fitting grooves 60 of the terminal accommodating portion 42 in the female housing 40 are squeezed by the squeezing surfaces 22 of the fitting projections 20 provided on the inner peripheral surface of the receptacle 11 of the mating male housing 10, as shown in FIG. 15. Thus, backlash between the male and female housings 10, 40 is prevented directly.

Simultaneously, the guide walls 17 provided on the outer peripheral surface of the receptacle 11 of the male housing 10 squeeze the second backlash preventing ribs 62 in the guide grooves 47 provided on the inner peripheral surface of the cover 43 of the female housing 40, as shown in FIG. 16. This can also contribute to preventing backlash between the two housings 10, 40.

As described above, backlash between the male housing 10 and the terminal accommodating portion 42 of the female housing 40 is prevented directly and fine sliding abrasion between the male and female terminal fittings 15, 30 accommodated in them can be suppressed more reliably.

A force may act to open the receptacle 11 of the male housing 10 when the fitting projections 20 squeeze the first backlash preventing ribs 61 to prevent backlash. However, such an opening is suppressed by the cover 43 of the female housing 40. Thus, the first backlash preventing ribs 61 are squeezed more reliably and, eventually, backlash is prevented more reliably.

The first backlash preventing ribs 61 provided in the fitting grooves 60 of the female housing 40 and the squeezing surfaces 22 of the fitting projections 20 for squeezing the first backlash preventing ribs 61 are tapered to become gradually taller from the tip side toward the rear end side in the connecting direction. Thus, the first backlash preventing ribs 61 are squeezed more gradually as the connection of the male and female housings 10, 40 proceeds. As compared to the case where the first backlash preventing ribs 61 are squeezed by a predetermined amount from the beginning, the connecting operation of the male and female housings 10, 40 is performed smoothly, and a good connection feeling can be obtained.

The invention is not limited to the above described and illustrated embodiment. For example, the following embodiments also are included.

The number of the pairs of the fitting projection and the fitting groove provided with the backlash preventing ribs and the arranged positions thereof are not limited to those illustrated in the above embodiment and can be appropriately selected.

The number and positions of the backlash preventing ribs provided on the inner surfaces of the fitting grooves are also not limited to those illustrated in the above embodiment and can be appropriately selected.

Although both the squeezing surfaces of the fitting projections and the backlash preventing ribs are tapered in the above embodiment, only one of them may be tapered or none may be tapered.

The front wall part of the cavity may be structured to be formed by the front wall portion of the front wall over the entire circumference. In this case, the terminal insertion hole is formed only in the front wall portion of the front wall.

The backlash preventing structure provided between the guide walls on the outer periphery of the male housing and the guide grooves on the inner periphery of the female housing may be omitted.

Although the waterproof connector is illustrated in the above embodiment, application to non-waterproof connectors is also similarly possible.

Although the connector of the type to be directly connected to the device is illustrated in the above embodiment, application to wire-to-wire connectors in which male and female housings are both connected to ends of harnesses is also similarly possible.

LIST OF REFERENCE SIGNS

10 . . . male housing
11 . . . receptacle
15 . . . male terminal
20 . . . fitting projection
21 . . . squeezing portion
22 . . . squeezing surface
30 . . . female terminal
40 . . . female housing
42 . . . terminal accommodating portion
43 . . . cover
50 . . . cavity
55 . . . terminal insertion hole
58 . . . seal ring
60 . . . fitting groove
61 . . . first backlash preventing rib (backlash preventing rib)
70 . . . front wall
71 . . . front wall portion
72 . . . tubular portion
80 . . . escaping groove

The invention claimed is:

1. A connector, comprising:

a male housing including a receptacle open forward and configured such that a male terminal is accommodated therein while projecting into the receptacle; and a female housing including a terminal accommodating portion having a cavity for accommodating a female terminal and fittable into the receptacle, and a front wall configured to provide a terminal insertion hole, through which the male terminal is to be inserted and that communicates with the cavity, by being mounted on a front surface of the terminal accommodating portion;

wherein:

a fitting projection extending in a front-back direction is formed on an inner peripheral surface of the receptacle in the male housing;

a fitting groove, into which the fitting projection is insertable from the front, is formed on an outer peripheral surface of the terminal accommodating portion in the female housing, and a backlash preventing rib extending in the front-back direction and to be squeezed between an inner surface of the fitting groove and an outer surface of the fitting projection is formed on the inner surface of the fitting groove; and the front wall is formed with an escaping groove configured to allow the fitting projection to be passed therethrough with a clearance and inserted into the fitting groove, wherein at least one of the backlash preventing rib and the outer surface of the fitting projection for squeezing the backlash preventing rib tapered to become gradually taller from a tip side toward a rear end side in a connecting direction.

2. The connector of claim 1, wherein:

the terminal accommodating portion of the female housing includes a cover to be fit to an outer periphery of the receptacle of the male housing; and a seal ring to be resiliently compressed between an outer periphery of a base end side of the terminal accommodating portion and an inner periphery of the receptacle is mounted on the outer periphery of the base end side of the terminal accommodating portion and the front wall presses the seal ring to prevent a fall of the seal ring.

3. The connector of claim 2, wherein at least one of the backlash preventing rib and the squeezing surface of the fitting projection for squeezing the backlash preventing rib is tapered to become gradually taller from a tip side toward a rear end side in a connecting direction.

* * * * *